US005125524A

United States Patent [19]

Hosoda et al.

[11] Patent Number: 5,125,524

[45] Date of Patent: Jun. 30, 1992

[54] COLLAPSIBLE BASKET FOR STORAGE AND TRANSPORT OF MANUFACTURED ARTICLES

[75] Inventors: Toshikazu Hosoda, Chiba; Koichiro Aida; Tamotsu Nakano, both of Tokyo, all of Japan

[73] Assignee: Sony Corporation, Japan

[21] Appl. No.: 540,330

[22] Filed: Jun. 19, 1990

[30] Foreign Application Priority Data

Jun. 19, 1989 [JP] Japan ..... 1-156345

[51] Int. Cl.[5] ..... B65D 7/24

[52] U.S. Cl. ..... 220/7; 220/23.4; 220/6

[58] Field of Search ..... 220/6, 23.4, 7

[56] References Cited

U.S. PATENT DOCUMENTS

| | | | |
|---|---|---|---|
| 1,180,294 | 4/1916 | Hunter . | |
| 1,338,608 | 4/1920 | Bench . | |
| 1,745,317 | 1/1930 | Sherman . | |
| 2,803,084 | 8/1957 | Frerking | 206/213 |
| 2,972,430 | 2/1961 | Johnson | 220/1.5 |
| 3,096,923 | 7/1963 | Piller | 220/6 |
| 3,527,339 | 9/1970 | Cipolla | 220/6 |
| 3,527,340 | 9/1970 | Cipolla | 220/6 |
| 3,796,342 | 3/1974 | Sanders et al. . | |
| 3,865,269 | 2/1975 | Coleman | 220/6 |
| 4,091,919 | 5/1978 | MacLeod et al. | 206/213 |
| 4,120,417 | 10/1978 | Aquino | 220/6 |
| 4,235,345 | 11/1980 | VandeDrink et al. | 220/6 |
| 4,248,346 | 2/1981 | Johnson | 206/334 |
| 4,491,231 | 1/1985 | Heggeland et al. . | |
| 4,542,930 | 9/1985 | Adams | 220/23.4 |
| 4,798,304 | 1/1989 | Rader . | |

FOREIGN PATENT DOCUMENTS

| | | |
|---|---|---|
| 0015859 | 2/1980 | European Pat. Off. . |
| 0075655 | 6/1982 | European Pat. Off. . |
| 3201068 | 8/1982 | Fed. Rep. of Germany . |

*Primary Examiner*—Joseph Man-Fu Moy
*Attorney, Agent, or Firm*—Ronald P. Kananen

[57] ABSTRACT

A collapsible basket for receiving printed boards. This basket comprises a pair of side plates on which a plurality of ribs are formed to define grooves for receiving the printed boards, and a pair of hinged end plates along with which the side plates define a storage space for the printed boards. A supporting member, one end of which is pivotably supported on one of the side plates, is positioned vertically when the basket is collapsed for storage and is positioned horizontally, such that the free end engages the opposite side plate to retain the side plates securely spaced from each other by a preselected distance for reinforcing the basket when assembled for use.

17 Claims, 6 Drawing Sheets

COLLAPSIBLE BASKET FOR STORAGE AND TRANSPORT OF MANUFACTURED ARTICLES

BACKGROUND OF THE INVENTION

The present invention relates generally to a basket structure for storage. In particular, the invention relates to a basket capable of receiving printed circuit boards to allow optimal storage and transport thereof. More particularly, the invention relates to a collapsible basket for facilitating storage thereof when not in use.

Usually, in processes of manufacturing, large resin and metal baskets or corrugated fiberboard boxes are used for storing or transporting. In electronics manufacturing, printed circuit boards are stored and moved in these types of containers. However, corrugated fiberboard boxes have the disadvantage of lower durability and, further, they produce undesirable paper dust with use. When used to transport printed circuit boards, this dust may interfere with the delicate functioning of electronic parts mounted on the printed boards. Large resin baskets are made of resin reinforced by metal or so forth, and thus the weight thereof is increased and manufacturing costs become high. Further, a large amount of space is necessary for the storage of such large baskets.

SUMMARY OF THE INVENTION

It is accordingly one object of the present invention to avoid the disadvantages of the prior art.

It is another object of the invention to provide a light basket which is collapsible for storage in a small area when not in use.

According to one aspect of the present invention, there is provided a collapsible basket which comprises a pair of first plates arranged substantially parallel to each other a pair of second plates respectively connected to the first plates to define a storage space flexible components provided on the first plates respectively, the flexible components allowing the second plates to be arranged closely proximate each other at a first preselected distance defining a close position, and a support member movable between first and second positions, the support member, in the first position, retaining the second plates spaced at a second preselected distance defining an open position and, in the second position, allowing the second plates to move toward each other to the close position.

In the preferred mode, a plurality of ribs are formed on the pair of second plates to define grooves for receiving a plurality of flat members, for storage of the flat members. The collapsible basket may be constructed such that one end of the support member is pivotably supported at one of the second plates and the other end thereof engages the other second plate to retain the second plates so as to be spaced from each other by the second preselected distance.

BRIEF DESCRIPTION OF THE DRAWINGS

The present invention will be understood from the detailed description given hereinbelow and from the accompanying drawings of the preferred embodiments which are given for explanation and understanding only and are not intended to imply limitation of the invention.

DESCRIPTION OF THE PREFERRED EMBODIMENT

Figure 1:
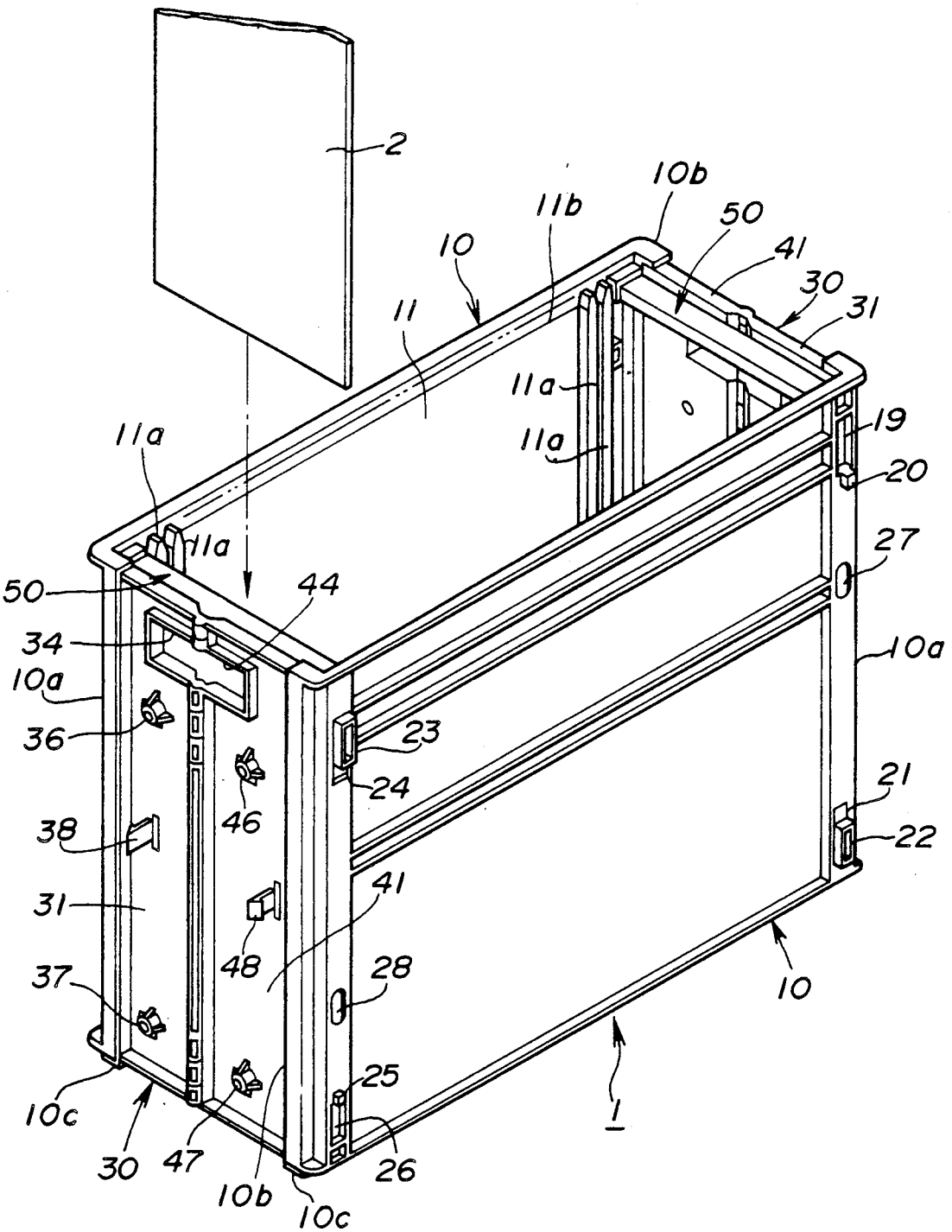
FIG. 1 is a perspective view which shows a basket for storing printed boards according to the present invention.
Figure 2:
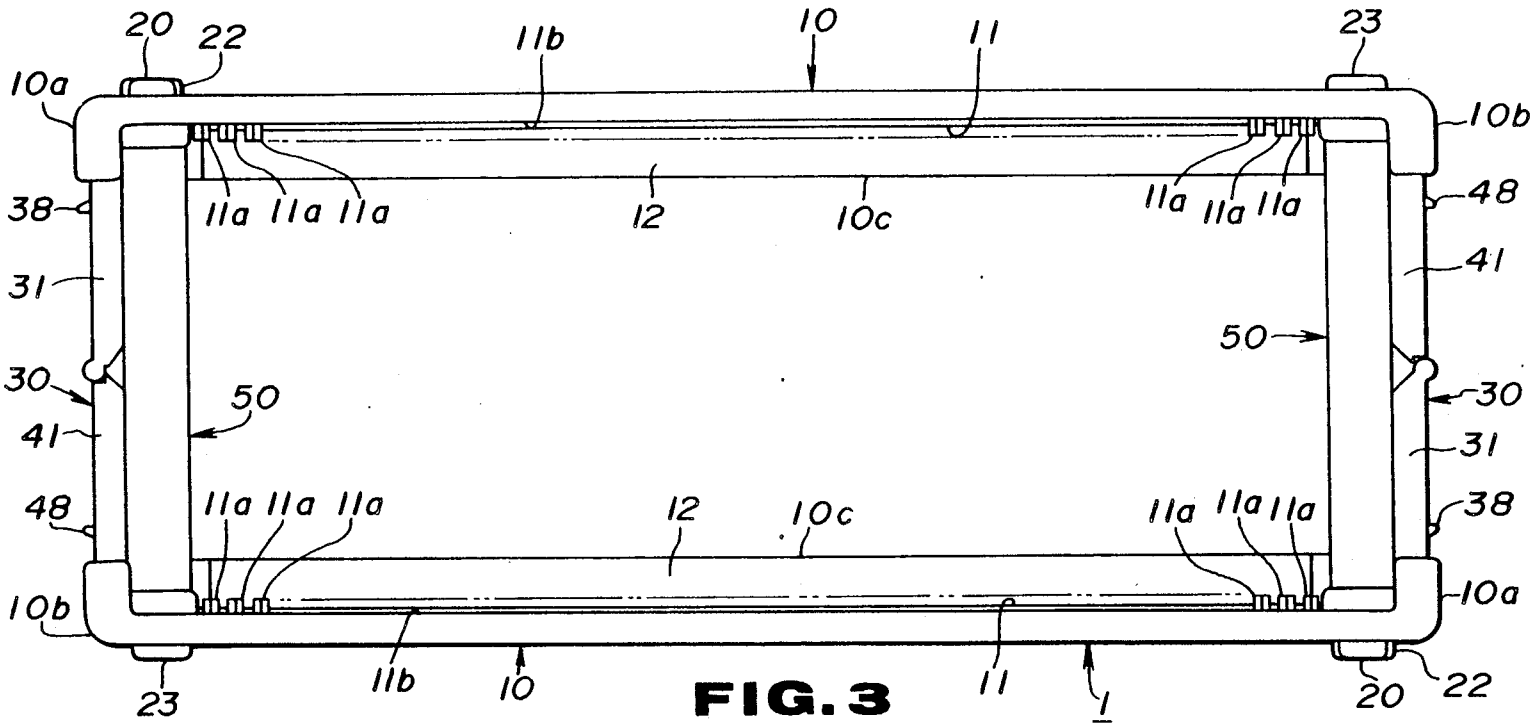
FIG. 2 is a plan view of FIG. 1.

Referring now to the drawings, particularly to FIGS. 1 and 2, there is illustrated a collapsible basket for storing printed boards according to the present invention. This basket 1 is made of plastic and includes generally a pair of substantially C-shaped side plates 10, a pair of hinged end plates 30, and four supporting members 50 (see FIG. 6). Each side plate 10 has a plurality of ribs 11*a* on its inner wall 11 which extend vertically and parallel to each other with preselected gaps to define a plurality of grooves for receiving the printed boards 2.

Each end plate 30 is foldable at its center and pivotable about corners or ends 10*a* and 10*b* of the side plates 10 so that the side plates meet or are spaced away from each other. Each supporting member 50 is pivotably supported at one of its ends by a corner of the respective side plate 10, so that it lies vertically on the inside of the corner 10*a* or 10*b* of the side plate 10 when the basket is folded up. When the basket is assembled for use, each supporting member retains the side plates 10 spaced from each other by a preselected distance, for receiving the printed boards between the ribs.

The rib 11*a* has tapered surfaces on its upper end for facilitating insertion of the printed board 2. An upper end 11*b* of the side plate 11 also has a tapered surface for the same purpose. Legs 10*c* are formed on lower edges of the side plates 10, each horizontally extending inwardly. Rubber strips 12 are attached on upper surfaces of the legs 10*c*, respectively to receive a bottom of the printed board 2 for absorbing shock caused by insertion thereof in the grooves between ribs 11*a*, thus protecting the edges of the board 2 from being damaged.

Figure 4:
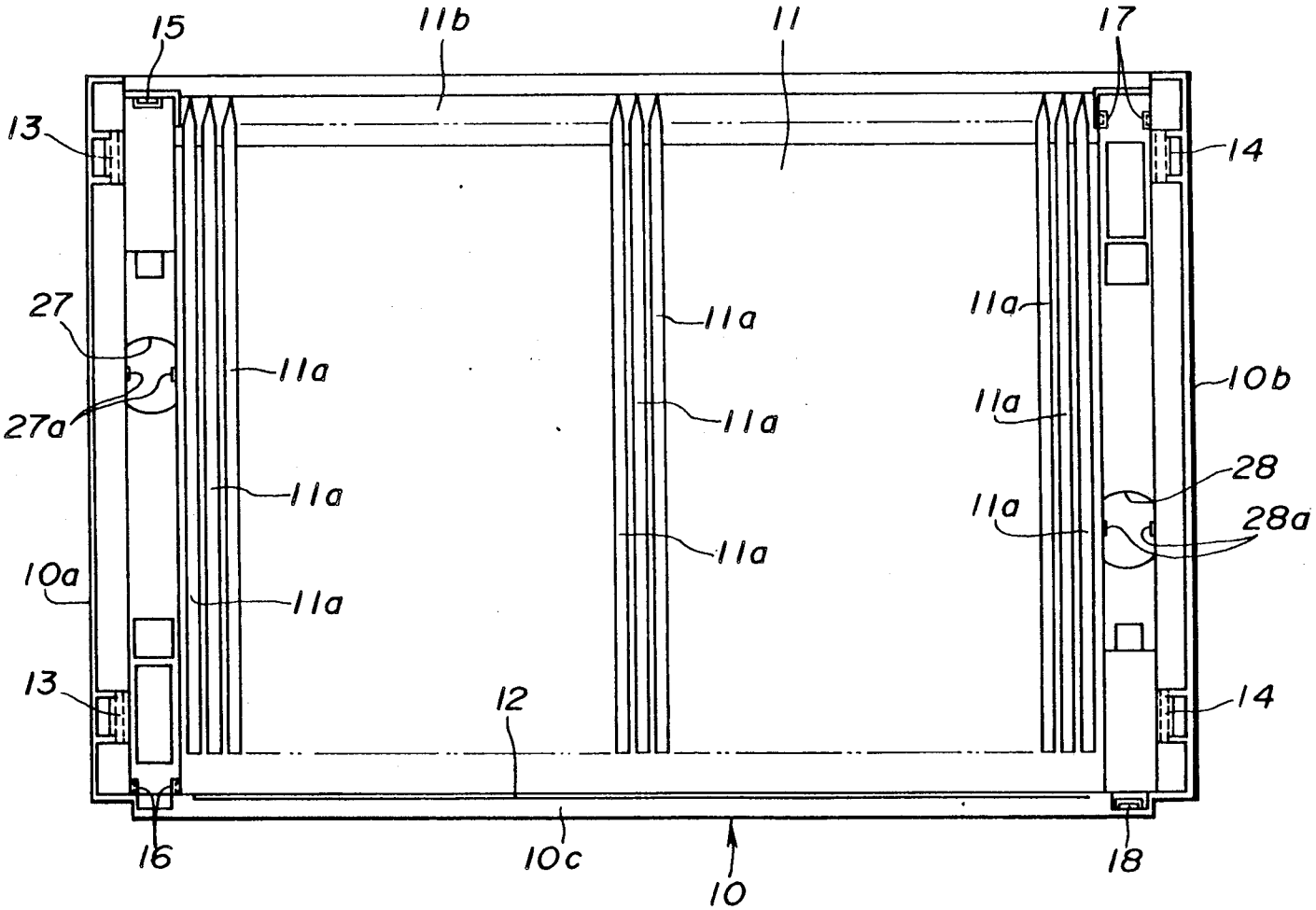
FIG. 4 is a side view which shows an inner wall structure of a side plate of a basket according to the invention.
Figure 5:
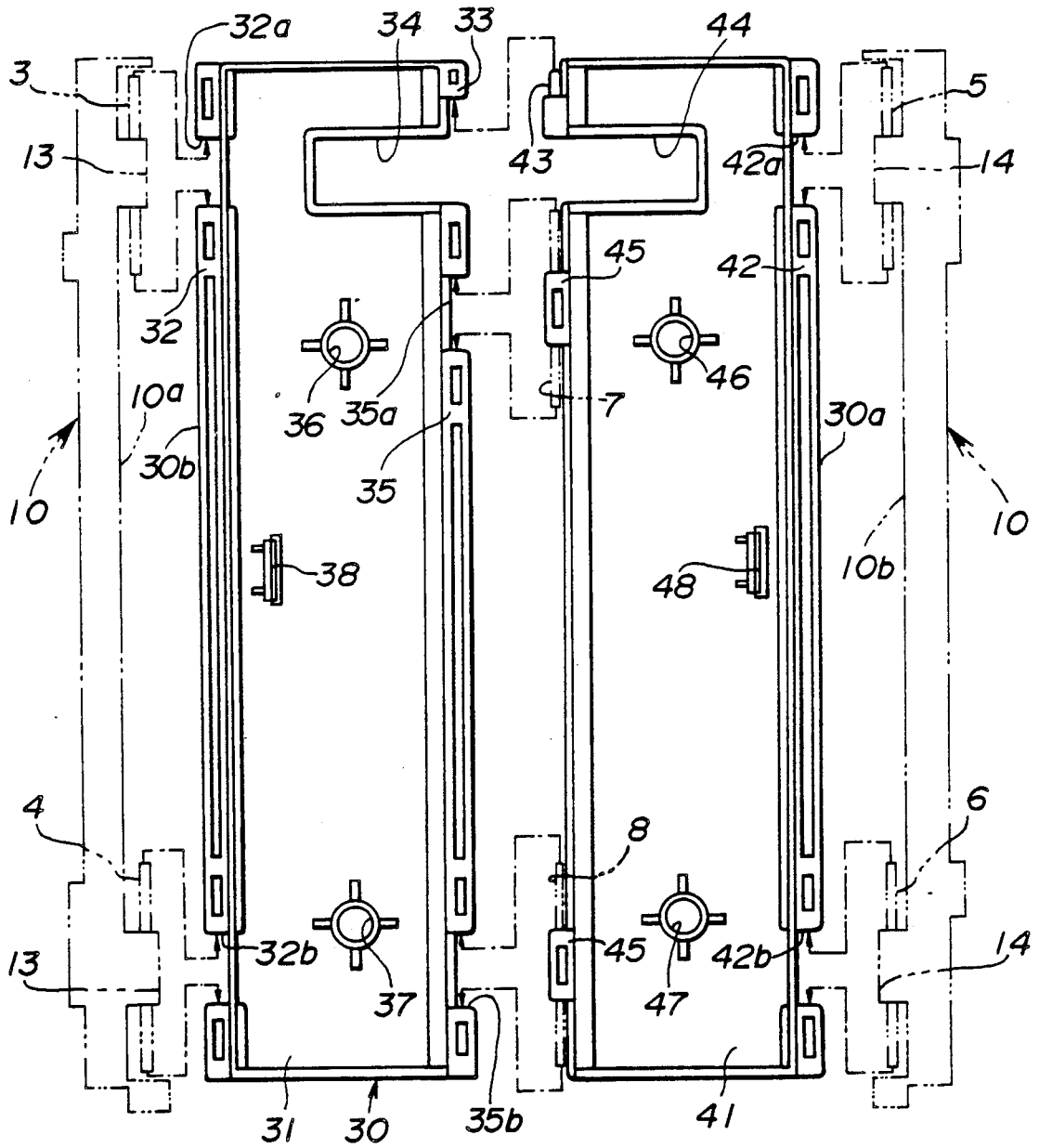
FIG. 5 is an exploded view which shows an end plate of a basket.

Shaft bushings 13 are, as shown in FIGS. 4 and 5, integrally formed on upper and lower sides of the L-shaped corner 10*a* of the side plate 10. Similarly, shaft bushings 14 are formed on upper and lower sides of the other corner 10*b*. They define a hinge in cooperation with shaft bushings provided on the end plates 30 as will be described hereinafter.

A hook 15 and bearing 16 are formed between the shaft bushings 13 and the outmost rib 11*a* on the upper and lower sides of the inner wall 11. The hook 15 engages one end of the supporting member 50 when the basket is assembled. The bearing 16 pivotally supports the other end of the supporting member. Similarly, on the other side of the inner wall 11, a hook 18 and bearing 17 are formed.

Referring to FIG. 1 again, a rectangular recessed portion 19 and a square protrusion 20 are formed on the upper outside of the corner 10*a* and a square recessed portion 21 and a hollow rectangular protrusion 22 are formed on the lower outside corner. On the corner 10*b*, a rectangular protrusion 23 and a square recessed portion 24 are formed on the upper side and a square protrusion 25 and a rectangular recessed portion 26 are formed on the lower side, in an arrangement complementary to the corner 10*a*. When a plurality of baskets are placed on their sides, the protrusions fit into the recessed portions of adjacent baskets, positioning them securely.

Openings 27 and 28 are provided in the corners 10*a* and 10*b* for releasing an end of the supporting members 50 from a locked position of the basket when assembling. Inside both of the openings 27 and 28, as shown in FIG. 4, pairs of protrusions 27*a* and 28*b* are formed to retain the supporting member vertically on the inside of the corners 10*a* and 10*b* when collapsed.

Referring to FIG. 5, the end plate 30 is shown. This end plate is provided with a pair of rectangular plastic plates 31 and 41 which are folded on hinges. The plate 31 has a cylindrical shaft bushing 32 on one side 30*b* connected to the side plate 10 at upper and lower portions at which cut-out portions 32*a* and 32*b* are formed for receiving the shaft bushings 13 provided on the corners of the side plate 10. Plastic shafts and 4 are inserted thereinto to complete the hinge structure. Similarly, the plate 41 has a cylindrical shaft bushing 42 in upper and lower sides in which cut-out portions 42*a* and 42*b* are formed to be rotatably supported by the other side plate 10 by insertion of plastic pins 5 and 6 thereinto.

On the other side of the plate 31 are provided a shaft bushing 33, a cut-out portion 34, and a long shaft bushing 35 having cut-out portions 35*a* and 35*b* formed in upper and lower portions thereof. On the other side of the plate 41 are provided a pin 43 inserted into the shaft bushing 33 of the plate 31, a cut-out portion 44 for defining an opening in conjunction with the cut-out portion 34 as a handle for when the basket is carried, and a pair of shaft bushings 45 inserted into the cut-out portions 35*a* and 35*b* of the plate 31.

By inserting shafts 7 and 8 through the shaft bushings of the plates 31 and 41, this hinge structure is completed. Hollow bosses 36, 37, 46, and 47 are provided on the outer wall of the plates 31 and 41 for positioning the basket, during automatic transfer by conveyor, for example. Hooks 38 and 48 are provided on the middle portion of the outer wall for engaging with each other when the end plates are folded to hold them closed.

Figure 6:
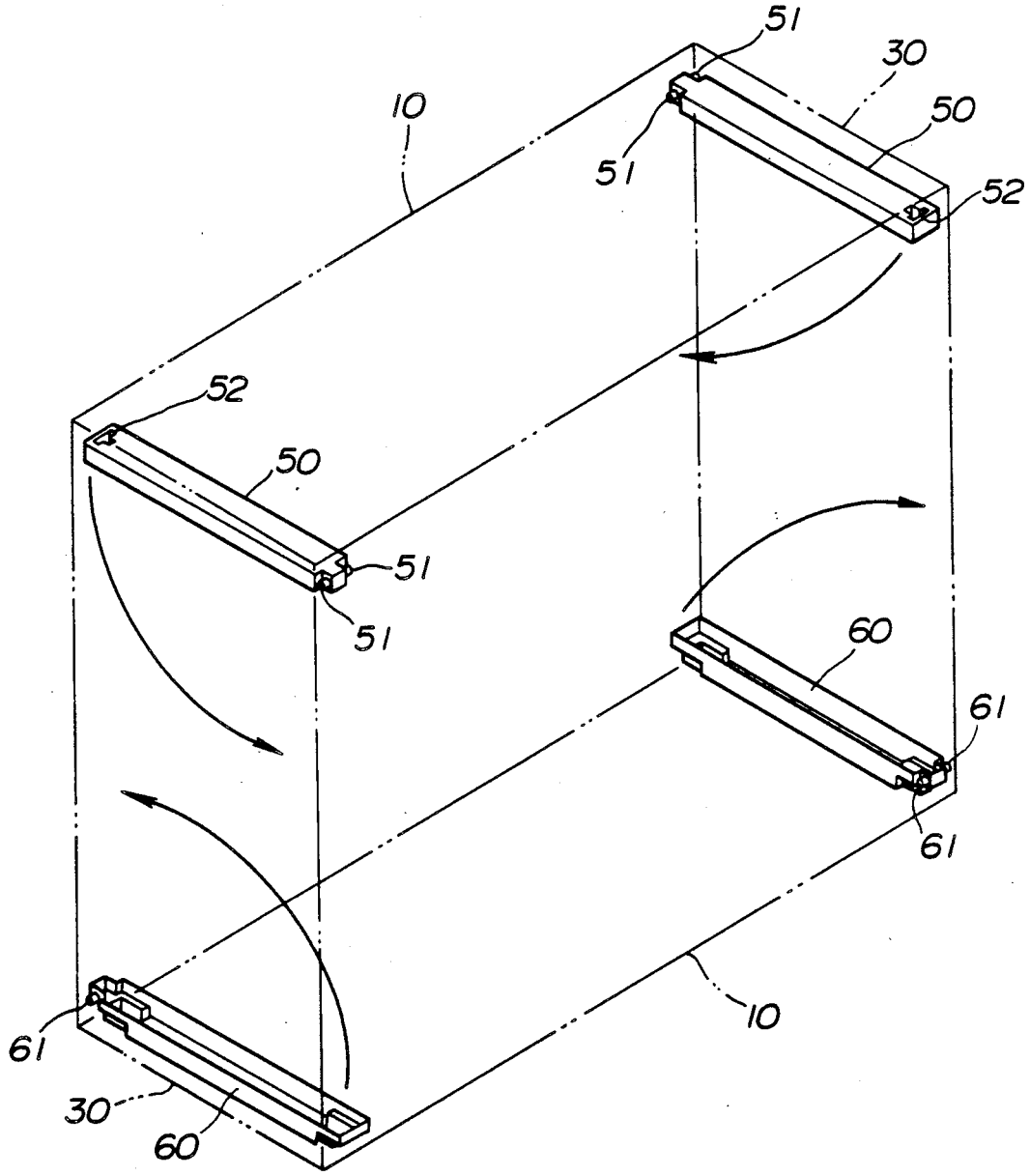
FIG. 6 is a perspective view which shows an arrangement of supporting members.

FIG. 6 shows the supporting members 50. Each supporting member 50 is substantially in the form of a square bar, and includes a pair of pins 51 on one end which are pivotably supported by the bearings 16 or 17 of the side plate 10 and a hole 52 on the other end, the free end, which is engaged with the hook 15 or 18. It is seen that the supporting members 50 at the top of the basket swing downwardly in the direction indicated by the upper arrows in FIG. 6, to be positioned vertically when the basket is folded. Conversely, the supporting members 50 at the top of the basket swing upwardly to be positioned horizontally, holding the side plates 10 suitably spaced from each other, when the basket is assembled.

With the above-mentioned basket structure, when the basket 1 is to be used, pulling the side plates 10 away from each other causes the end plates 30 to open to 180°. Pushing the portion of the supporting members 50 visible through the openings 27 and 28, releases the retained ends of the supporting members to allow them to swing 90°, so that the openings formed in the ends thereof may be engaged with the hooks 15 or 18. Thereby, the basket 1, as shown in FIG. 1, may be assembled easily. The pushing of the supporting members through the openings 27 and 28 may be carried out manually. Alternatively, it may be carried out automatically utilizing instruments (not shown).

When a printed board 2 is inserted into the grooves between ribs 10*a*, the lower edge thereof contacts the rubber strip 12 attached on the legs 10*c* to absorb shock at that time, thereby preventing the printed board from being damaged. The bottom of the basket has an opening and, by pushing the lower edge of the stored printed board upward therethrough, it can be easily removed from the top of the basket.

In addition, when the basket 1 is transferred by a carrier machine, for example, positioning the basket 1 on the machine may be accomplished easily and precisely by using the hollow bosses 36, 37, 46, 47.

Figure 7:
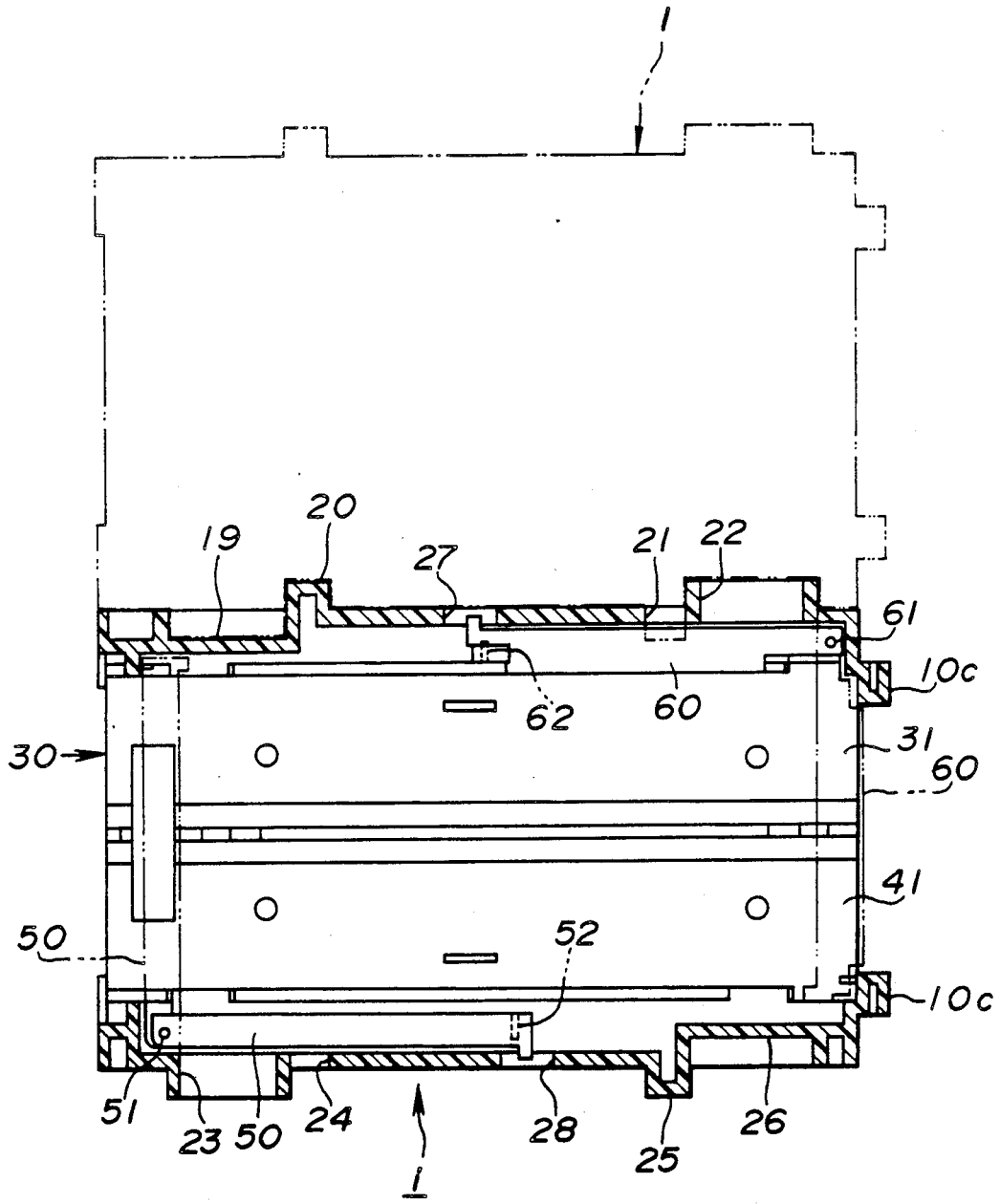
FIG. 7 is a sectional view which shows a stack of baskets.

Referring to FIG. 7, a row of baskets 1 is illustrated. The recessed portions 19 and 26 and the protrusions 22 and 23 of one side of a first basket respectively engage the protrusions 23 and 22 and the recessed portions 26 and 19 of the facing side of the adjacent basket, thereby preventing the baskets from shifting and/or tumbling easily. Alternatively, when the baskets are stacked vertically, the legs 10*c* of an upper basket fit securely onto a ledge formed by a top surface of the supporting members 50, retained by the higher edge of the inner wall of the plate 31, allowing secure stacking of the baskets without shifting. Therefore, many printed boards 2 can be stored and safely transported in uniform baskets.

Figure 3:
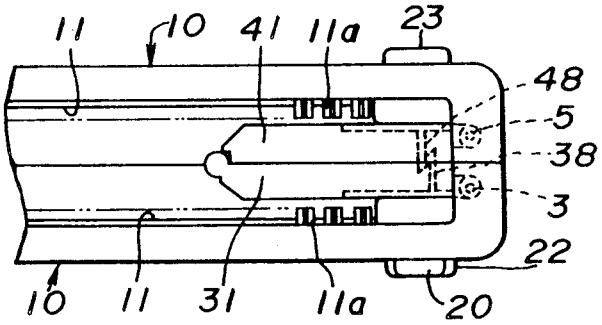
FIG. 3 is a partial plan view which shows the structure of the folded basket of FIG. 1.

When the baskets are not in use, as shown in FIG. 6, the supporting members 50 fold into the inner wall of the side plate to a vertical position, and the end plates 30 fold inwardly to join the side plates 10, the inner edges of the legs 10*c* thereof contacting each other. The hooks 38 and 48 of the end plate, as shown in FIG. 3, then engage each other, preventing the basket from opening accidentally. The folded basket has a thickness of less than one-third that of the opened basket, thus reducing the area necessary for storage.

While the present invention has been disclosed in terms of the preferred embodiment in order to facilitate better understanding thereof, it should be appreciated that the invention can be embodied in various ways without departing from the principles thereof. Therefore, the invention should be understood to include all possible embodiments and modifications to illustrated embodiments which can be embodied without departing from the principle of the invention as set out in he appended claims. For example, substrates may be stored in the basket in place of printed boards. Further, by providing adjustments for varying length of the supporting members or the angle of the opened end plates, printed boards having different sizes can be stored in the basket.

What is claimed is:

1. A collapsible basket comprising:

a pair of first plates arranged substantially parallel to each other;

a pair of second plates respectively connected to said first plates, to define a storage space between said plates;

moving means respectively provided on said first plates, said moving means allowing said second plates to be arranged closely proximate each other at a first preselected distance defining a close position and to be moved away from each other to an open position; and four support members movable between first and second positions, each said support member, in said first position, retaining said second plates spaced at a second preselected distance defining said open position and, in said second position, allowing said second plates to move toward each other;

wherein a first end of each said support member is pivotably supported on a respective corner of one of said second plates, and the second end of each said support member rotates to engage the respective corner of the other one of said second plates, to retain second plates spaced from each other at said second preselected distance.

2. A collapsible basket as set forth in claim 1, wherein a plurality of ribs are formed on each of said pair of second plates, to define grooves for receiving a plurality of flat members for storage of said flat members.

3. . A collapsible basket as set forth in claim 1, said moving means comprising hinges and said first plates including first and second segments which swing inward on said hinges, wherein said first and second segments fold toward each other.

4. A collapsible basket as set forth in claim 1, wherein each said second plate includes lock means for locking said second end of each respective one of said support members, when said support member is retained on said second plate while said second plates are in said close position.

5. A collapsible basket as set forth in claim 4, wherein each said second plate includes an opening allowing access to said second end of each respective one of said support members, when said second end is locked by said lock means, from outside of the basket to release said locked second end.

6. A collapsible basket as set forth in claim 1, wherein said second plate has engaging means which includes a recessed portion and a protrusion for preventing adjacent baskets from shifting relative to each other when a plurality of the baskets are arranged adjacent go each other with respective recessed portions and protrusions engaged.

7. A collapsible basket as set forth in claim 3, wherein said first and second segments have hooks for respective engagement with each other when said first plates are fully folded.

8. A collapsible basket as set forth in claim 2, further comprising an elastically deformable member which is disposed on a lower portion of each said second plate for absorbing shock caused by insertion of a flat member into the basket, to prevent a lower edge of said flat member from being damaged.

9. A collapsible basket as set forth in claim 1, wherein said second plates further include protrusions on a lower surface thereof, respective pairs of said protrusions corresponding to a ledge defined by the length of said a respective one of said support members such that one basket may be securely stacked upon another.

10. A collapsible basket as set forth in claim 1, wherein said second end of each said support member is connected to the respective one of said second plates by a hook means.

11. A collapsible basket comprising:

a pair of first plates arranged substantially parallel to each other;

a pair of second plates respectively connected to said first plates, to define a storage space between said plates;

flexible moving means respectively provided on said first plates, said moving means allowing said second plates to be arranged closely proximate each other at a first preselected distance defining a close position and to be moved away from each other to an open position; and a plurality of support members movable between first and second positions, each said support member, in said first position, retaining said second plates spaced at a second preselected distance defining said open position and, in said second position, allowing said second plates to move toward each other;

wherein a first end of each support member is pivotably supported on a respective one of said second plates, and the second end of each said support member rotates to engage the other respective one of said second plates, to retain said second plates spaced from each other at said second preselected distance.

12. A collapsible basket as set forth in claim 11, wherein a plurality of ribs are formed on each of said pair of second plates, to define grooves for receiving a plurality of flat members for storage of said flat members.

13. A collapsible basket as set forth in claim 11, wherein each said second plate includes lock means for locking said second end of each respective one of said support members, when said support member is retained on said second plate while said second plates are in said close position.

14. A collapsible basket as set forth in claim 13, wherein each said second plate includes an opening allowing access to said second end of each respective one of said support members, when said second end is locked by said lock means, from outside of the basket to release said locked second end.

15. A collapsible basket as set forth in claim 11, wherein said second plate has engaging means which includes a recessed portion and a protrusion for preventing adjacent baskets from shifting relative to each other when a plurality of the baskets are arranged adjacent to each other with respective recessed portions and protrusions engaged.

16. A collapsible basket as set forth in claim 12, further comprising an elastically deformable member which is disposed on a lower portion of each said second plate for absorbing shock caused by insertion of a flat member into the basket, to prevent a lower edge of said flat member from being damaged.

17. A collapsible basket as set forth in claim 11, wherein said second plates further include protrusions on a lower surface thereof, respective pairs of said protrusions corresponding to a ledge defined by the length of a said respective one of said support members such that one basket may be securely stacked upon another.

* * * * *